US010378550B2

(12) United States Patent
Lim et al.

(10) Patent No.: US 10,378,550 B2
(45) Date of Patent: Aug. 13, 2019

(54) APPARATUS FOR PREVENTING AXIAL-FLOW COMPRESSOR FROM STALLING BY EMPLOYING CASING TREATMENT

(71) Applicant: KOREA AEROSPACE RESEARCH INSTITUTE, Daejeon (KR)

(72) Inventors: Byeung Jun Lim, Daejeon (KR); Tae Choon Park, Daejeon (KR); Young Seok Kang, Daejeon (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 1091 days.

(21) Appl. No.: 14/772,149

(22) PCT Filed: Dec. 18, 2012

(86) PCT No.: PCT/KR2012/011046
§ 371 (c)(1),
(2) Date: Sep. 2, 2015

(87) PCT Pub. No.: WO2014/098276
PCT Pub. Date: Jun. 26, 2014

(65) Prior Publication Data
US 2016/0010652 A1 Jan. 14, 2016

(51) Int. Cl.
*F02D 27/00* (2006.01)
*F04D 27/02* (2006.01)
(Continued)

(52) U.S. Cl.
CPC ..... *F04D 27/002* (2013.01); *F04D 19/002* (2013.01); *F04D 27/0215* (2013.01);
(Continued)

(58) Field of Classification Search
CPC . F01D 11/08; F01D 11/22; F04D 3/00; F04D 29/547; F04D 29/688;
(Continued)

(56) References Cited

U.S. PATENT DOCUMENTS 5,186,953 A * 2/1993 Minaudo ..... B29C 33/202 425/451.9
6,736,594 B2 5/2004 Irie et al.
(Continued)

FOREIGN PATENT DOCUMENTS

EP 2434164 A1 3/2012
JP 2002-188600 A 7/2002
(Continued)

*Primary Examiner* — Mark A Laurenzi
*Assistant Examiner* — Mickey H France
(74) *Attorney, Agent, or Firm* — Rabin & Berdo, P.C.

(57) ABSTRACT

An apparatus for preventing an axial-flow compressor from stalling by employing a casing treatment includes an outer casing having an inner wall with a slot formed to face a rotor blade, an inner casing moveable so as to open the slot in an unstable operating region and close the slot of the outer casing in a stable operating region, and a drive means for moving the inner casing along the axial direction of the outer casing. Thus, the apparatus can be applied not only to a casing treatment structure where the slope of a slot does not vary with the rotational position of the rotor, but also to a casing with a variously shaped slot such as a radial slot or an axial skewed slot.

11 Claims, 12 Drawing Sheets

(51) Int. Cl.

| | |
|---|---|
| ***F04D 29/52*** | (2006.01) |
| ***F04D 29/68*** | (2006.01) |
| ***F04D 19/00*** | (2006.01) |
| ***F04D 27/00*** | (2006.01) |

(52) U.S. Cl.
CPC ..... *F04D 29/522* (2013.01); *F04D 29/526* (2013.01); *F04D 29/685* (2013.01)

(58) Field of Classification Search
CPC .... F04D 29/528; F04D 29/685; F04D 29/522; F04D 29/526; F04D 15/0027; F04D 27/0215; F04D 27/002; F04D 19/002
USPC ..... 415/128, 173.1, 221
See application file for complete search history.

(56) References Cited

U.S. PATENT DOCUMENTS

| | | | | |
|---|---|---|---|---|
| 2003/0002982 | A1* | 1/2003 | Irie | F01D 11/08 415/220 |
| 2010/0092278 | A1* | 4/2010 | Major | F01D 17/162 415/160 |
| 2012/0285554 | A1* | 11/2012 | Lohkamp | G05D 16/208 137/487.5 |

FOREIGN PATENT DOCUMENTS

| | | | |
|---|---|---|---|
| JP | 2003-106293 | A | 4/2003 |
| JP | 2003-227497 | A | 8/2003 |
| KR | 10-1025867 | B1 | 3/2011 |

* cited by examiner

APPARATUS FOR PREVENTING AXIAL-FLOW COMPRESSOR FROM STALLING BY EMPLOYING CASING TREATMENT

TECHNICAL FIELD

The present disclosure relates to an apparatus for preventing an axial-flow compressor from stalling by employing a casing treatment.

BACKGROUND ART

As a major component for aircraft engine or industrial gas turbine, the compressor equipped with several rotational blades operates to draw in air and compress the same. Active researches have been done on the compressors, to find ways to maximize pressure ratio or efficiency at the respective ends.

The compressor often suffers performance deterioration of the entire system, due to unstable flow structure such as stall or surge occurring in the compressor when unexpected situation occurs near the operating line where high pressure and efficiency are available. For example, in the aircraft engine, when the pressure at the compressor outlet is instantaneously rises beyond appropriate range, airflow at the compressor inlet is separated from the blade surface and flow, entering "stall" state which causes instability of the engine or overall compression system.

To prevent stall, active control and passive control may be employed. One of the representative examples of the active control is to jet high pressure air to around the end of the blade where the compressor stall occurs first, thereby preventing compressor stall and extending the area of operation. For the passive control, a way of forming various forms of recesses such as grooves or slots and re-circulating high pressure air at the downstream to upstream through casing treatment, thereby preventing or delaying occurrence of stall and subsequently extending area of operation.

The former method is capable of preventing stall without compromising efficiency. However, the method is disadvantageous as it can be hardly adapted for use in high speed compressors. The latter method is easily adaptable to the compressors and can help improve operational stability in view of delay of stall occurrence. However, the method has shortcoming of negative influence on the performance of the compressor, such as deteriorated compressor efficiency in exchange for stall prevention.

In order to address shortcomings particularly related with the latter method, as illustrated in FIG. 12, KR Patent No. 10-1025867 proposes "Fluid stabilizer for axial-flow impeller". As disclosed in KR Patent No. 10-1025867, the fluid stabilizer includes drive portions 700 arranged per regions divided along a circumferential direction of the casing 500, which are moved in a radial direction of the casing 500, thus causing an adjustment rib 620 to be inserted into an adjustment hole 610. More specifically, the casing 500 is divided into four regions, and the drive portions 700 are arranged in each one of the divided regions. This is applicable to a particular casing treatment structure with uniform arrangement of the adjustment holes in which the adjustment hole 610 is arranged in 12 o'clock position in the region I, the adjustment hole 610 is in 3 o'clock position in the region II, the adjustment hole 610 is arranged in 6 o'clock position in the region III, the adjustment hole 610 is in 9 o'clock position in the region IV. That is, the structure requires that the direction the drive portions 700 are moved, the directions the adjustment holes 610 are inclined, and the directions of the adjustment ribs 620 be in agreement with each other.

The above requirement causes a shortcoming of deteriorated effect of preventing or delaying occurrence of stall by re-circulating the high pressure air at the downstream to upstream, because, when it is assumed that the rotor is rotated in a clockwise direction, by the time the blade (i.e., rotor) passes the 12 o'clock position of the region I and about to exit the region I, the direction of slope of the adjustment hole 610 is opposite to the rotational direction l of the blade, according to which the flow does not enter the adjustment hole 610 or is reduced. Further, with reference to a radius of the casing, the slope of the adjustment hole 610 facing the blade edge varies according to the rotational position of the blade, thus giving negative influence on the overall stability of the axial-flow compressor.

DISCLOSURE OF INVENTION

Technical Problem

Accordingly, an objective of the present disclosure is to provide an apparatus for preventing an axial-flow compressor from stalling by employing a casing treatment, which can prevent inabilities such as stall from occurring, without compromising performance such as efficiency of the compressor.

Further, an objective of the present disclosure is to provide an apparatus for preventing an axial-flow compressor from stalling by employing a casing treatment, which is applicable to a casing treatment structure in which slopes of slots remain unchanged according to rotational position of a rotor blade.

Additional objectives other than those specifically mentioned above may be achieved by the configuration of the present disclosure.

Solution to Problem

In order to achieve the objects mentioned above, an apparatus for preventing an axial-flow compressor from stalling by employing a casing treatment according to an exemplary embodiment is provided, in which the axial-flow compressor includes an outer casing having a slot formed in an inner wall faced with a rotor, and in which the apparatus includes an inner casing moveable in an axial direction of the outer casing to open or close the slot of the outer casing, and a drive means to move the inner casing in an axial direction of the outer casing.

The outer casing may comprise a cavity in fluid communication with the slot in the axial direction of the outer casing, and being positioned within the outer casing; and a slot in fluid communication with the cavity in a direction of wall thickness of the outer casing.

The drive means may comprise a connecting member connected with the inner casing and extended externally through the slot; and a move means to move the connecting member in the axial direction of the outer casing.

The move means may comprise a cylinder connected with the connecting member, and an interior of which is divided by a partition into a left side and a right side; a first valve and a second valve to control an inflow of a high pressure air at a downstream of the axial-flow compressor into the cylinder; and a third valve and a fourth valve to control an outflow of the high pressure air from the cylinder.

The first valve and the third valve may be connected with the left side of the cylinder, and the second valve and the fourth valve are connected with the right side of the cylinder.

An interval in fluid communication between the slot and the cavity of the outer casing may correspond to a thickness of the inner casing.

At a portion in fluid communication between the slot and the cavity, an airtightness maintaining member may be installed between the outer casing and the inner casing.

The inner casing may be moved so that the slot is open in an unstable operating region, and is closed in a stable operating region.

According to another exemplary embodiment, an apparatus for preventing an axial-flow compressor from stalling by employing a casing treatment is provided, in which the axial-flow compressor comprises a casing having a plurality of slots formed in an inner wall faced with a rotor, the apparatus comprising: a plurality of sliders to be slidably inserted into the plurality of slots, respectively; a plurality of first links, one ends of which are connected with the plurality of sliders, respectively, and being rotatable relative to the plurality of sliders; a plurality of second links, one ends of which are connected with the other ends of the plurality of first links, respectively, and being rotatable relative to the other ends of the plurality of first links; and a plurality of rotational shafts fixedly coupled with the other ends of the plurality of second links, respectively.

Each of the plurality of sliders and each of the plurality of first links coupled with each other may be connected to be rotated relative to each other through a first ring member.

Each of the plurality of the first links and each of the plurality of second links coupled with each other may be connected to be rotated relative to each other through a second ring member.

A drive force transmitting member may be disposed between the plurality of rotational shafts so that the plurality of rotational shafts are rotated in a same direction.

The drive force transmitting member may be a gear.

The apparatus may further comprise a drive portion to rotate one of the plurality of rotational shafts as a driving shaft.

The drive portion may comprise a fixing member and an actuator, wherein one end of the fixing member is fixed to one of the plurality of rotational shafts and one end of the actuator is connected with the other end of the fixing member with a degree of freedom to rotate the fixing member.

The other end of the actuator may be connected with the casing through a third ring member having a ring shape, while having a degree of freedom.

In an unstable operating region, the plurality of sliders may be ascended within the plurality of slots to open the plurality of slots, while in a stable operating region, the sliders may be descended within the plurality of slots to close the plurality of slots.

A circle formed by the plurality of rotational shafts may have a same center of curvature as that of the casing.

According to yet another exemplary embodiment, an apparatus for preventing an axial-flow compressor from stalling by employing a casing treatment is provided to prevent stall from occurring in the axial-flow compressor which includes a casing having a plurality of slots formed in an inner wall faced with a rotor, in which the apparatus may include a plurality of sliders to be slidably inserted into the plurality of slots, respectively, a plurality of rods connected with the plurality of sliders, respectively, a plurality of rollers connected with one ends of the plurality of rods, respectively, to be rotated relative to the plurality of rods, and an arm on which the plurality of rollers are movably provided, and which is disposed to have a same center of curvature as that of the casing.

The slider of the plurality of sliders and the rod of the plurality of rods, which are connected with each other, may be integrally formed with each other.

The arm may comprise an upper rail and a lower rail which are connected with each other to form a closed curve, and the plurality of rollers are moved in a rolling motion between the upper rail and the lower rail.

A slope of the plurality of slots may be in a direction of radius of the casing.

The apparatus may comprise a drive portion to drive the arm in the direction of radius of the casing.

The plurality of rollers may have a concave portion on an outer circumference in a circumferential direction, and the upper rail and the lower rail each may comprise a protrusion to be inserted into the concave portion.

In an unstable operating region, the plurality of sliders may be ascended within the plurality of slots to open the plurality of slots, while in a stable operating region, the sliders may be descended within the plurality of slots to close the plurality of slots.

The plurality of rods may be constantly aligned in the direction of radius of the casing.

When the arm is moved to a direction away from the casing, the plurality of rollers may be moved so that intervals between the plurality of rollers increase.

when the arm is moved to a direction close to the casing, the plurality of rollers may be moved so that intervals between the plurality of rollers decrease.

Advantageous Effects of Invention

According to various exemplary embodiments with configurations mentioned above, it is possible to prevent stall of the compressor without compromising efficiency thereof and thus extending operating region, by closing the casing treatment when the compressor is operated in a region at a significant distance from the stall, and then extending an operating line by opening the casing treatment when the operating line approaches close to the stall.

Further, the exemplary embodiments are applicable to not only the casing treatment structure in which the slope of the slot does not vary according to the rotational position of the rotor, but also the casing having various shapes of slots including radial slot or axial skewed slot, etc.

Further, when necessary, it is possible to simply open and close the casing treatment formed on the outer casing with an inner casing and a drive means to drive the inner casing.

Further, it is possible to move the inner casing to a direction of the compressor shaft to drive the inner casing with efficiency and without requiring a separate drive energy source, by utilizing the high pressure air at the downstream of the compressor.

Further, since the apparatus is applicable also to the casing in which the slope of the slot does not vary in the circumferential direction, the apparatus can contribute to the improvement of the overall stability of the axial-flow compressor.

Further, it is possible to open or close the slot of the casing by simply rotating the rotational shaft corresponding to the driving shaft with the drive portion, and thus moving the slider.

Further, the apparatus is applicable also to the casing in which the slope of the slot does not vary in the circumferential direction, since the apparatus can increase or decrease a distance between a plurality of rods and rollers connected therewith on the arm according to opening or closing of the slot.

Meanwhile, the effects of the present disclosure are not limited to those described above and the other effects that can be achieved from the configurations of the present disclosure as described below are included as the effect of the present disclosure.

MODE FOR CARRYING OUT THE INVENTION

Figure 1:
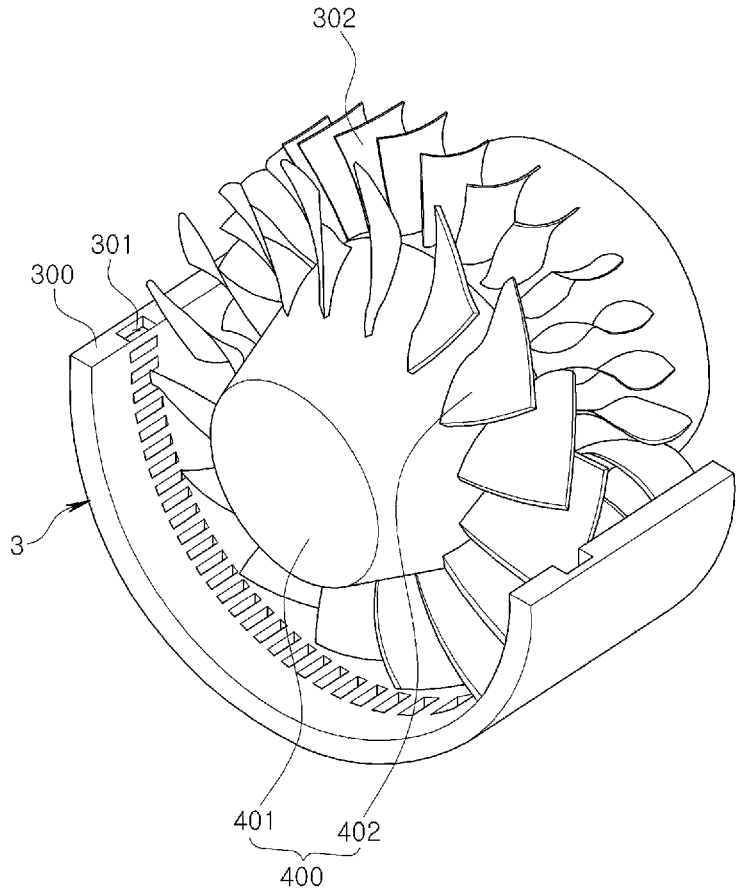
FIG. 1 illustrates one example in which casing treatment is formed on an outer casing, with respect to main configurations.
Figure 2:
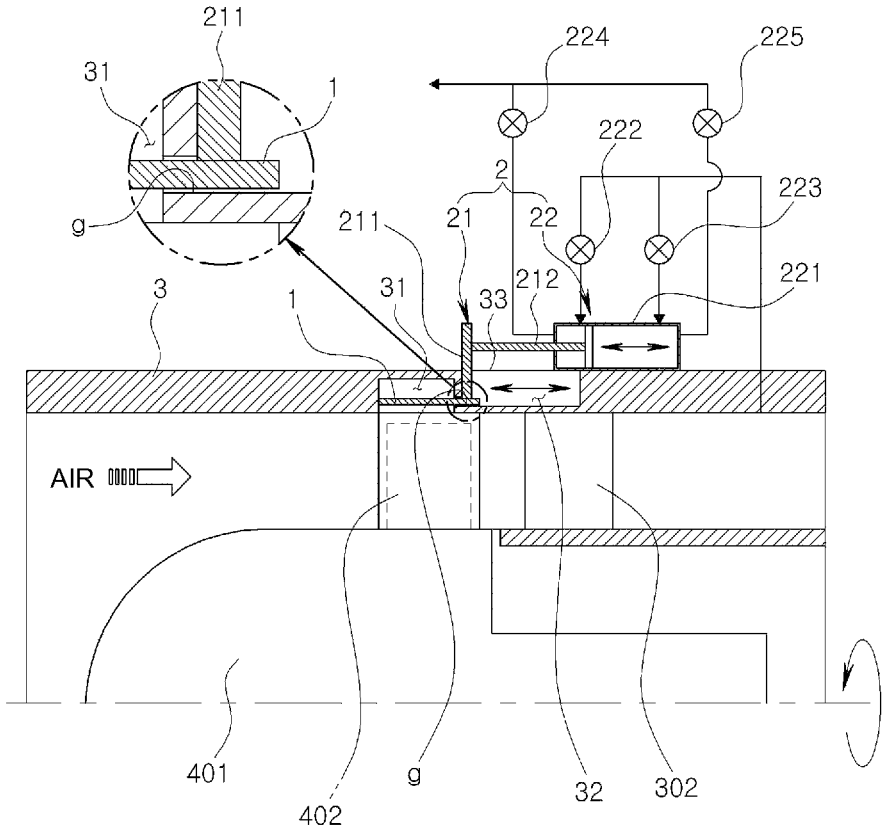
FIG. 2 is a cross sectional view taken on line A-A of FIG. 3, illustrating main configurations of an apparatus for preventing an axial-flow compressor from stalling by employing a casing treatment (shortly, "stall preventing apparatus of axial-flow compressor") according to an exemplary embodiment of the present disclosure.
Figure 3:
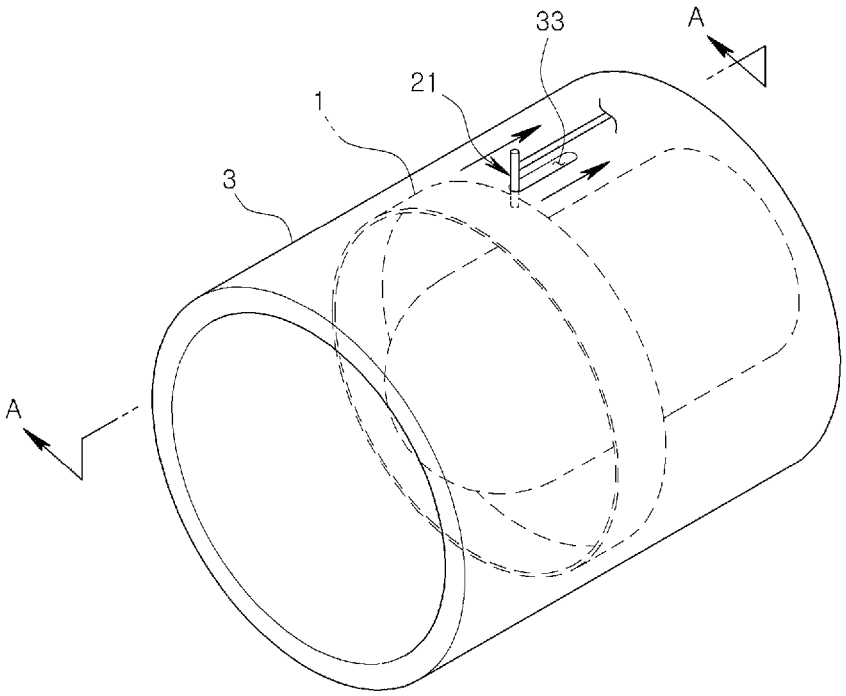
FIG. 3 is a perspective view of a main configuration, illustrating the stall preventing apparatus of axial-flow compressor of FIG. 2 being mounted to an outer casing.
Figure 7:
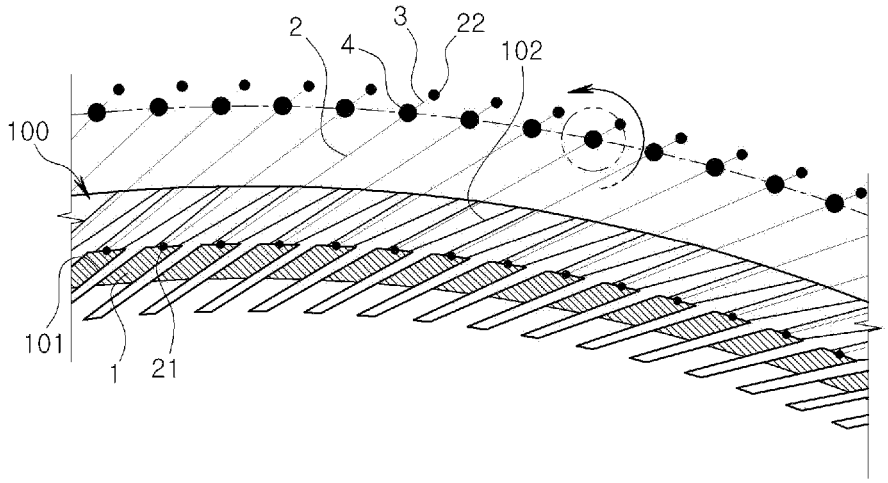
FIG. 7 illustrates a rotational shaft rotated counterclockwise by 180 degrees compared to the state illustrated in FIG. 5, in order to open the slot of the casing by using the stall preventing apparatus of axial-flow compressor of FIG. 5.
Figure 8:
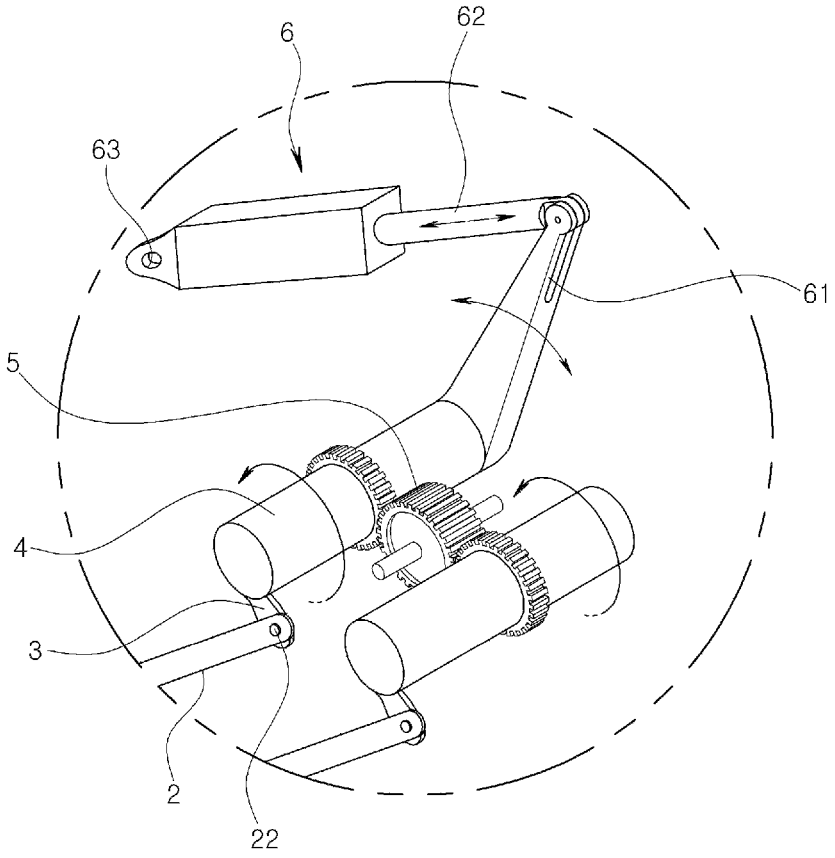
FIG. 8 is a partially enlarged view of encircled area "A" of FIG. 5, illustrating an example of arrangement of a rotational shaft and a driving force transmitting member.
Figure 9:
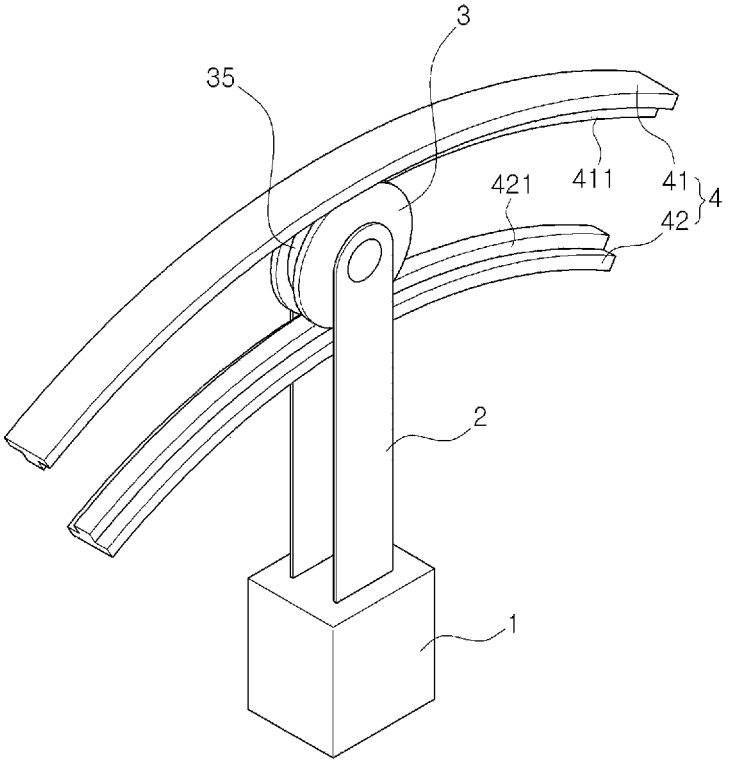
FIG. 9 illustrates a main configuration of a stall preventing apparatus of axial-flow compressor according to yet another exemplary embodiment of the present disclosure.
Figure 10:
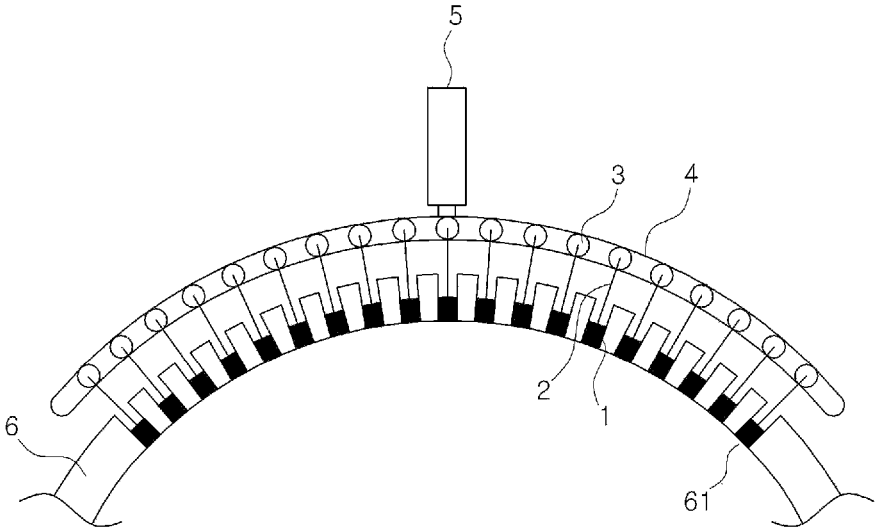
FIG. 10 illustrates the state in which the slot of the casing is closed by using the stall preventing apparatus of axial-flow compressor of FIG. 9.
Figure 11:
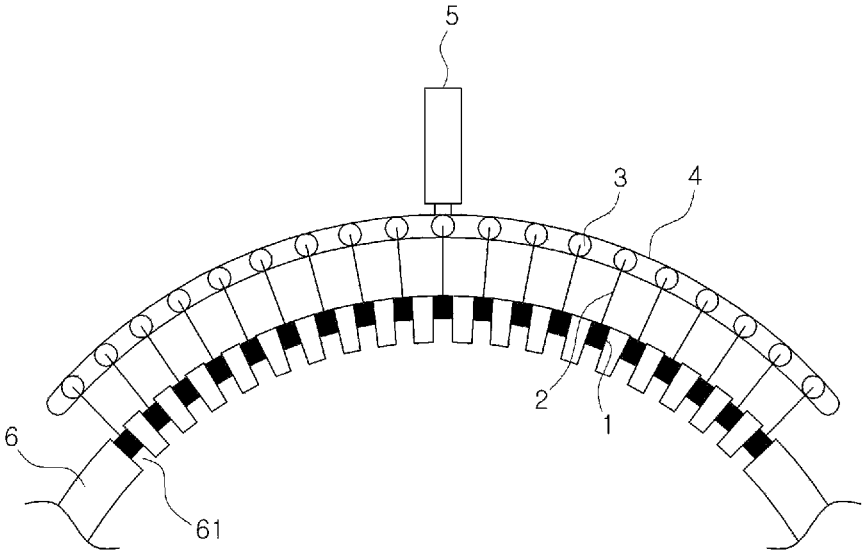
FIG. 11 illustrates the state in which the slot of the casing is opened by using the stall preventing apparatus of axial-flow compressor of FIG. 9.

Hereinbelow, an apparatus for preventing an axial-flow compressor from stalling by employing a casing treatment (hereinbelow, "stall preventing apparatus of axial-flow compressor") according to an exemplary embodiment (first exemplary embodiment) of the present disclosure will be described with reference to FIGS. 1 to 3. Meanwhile, for convenience of explanation, the same reference numerals may be designated to different elements to each other in first to third exemplary embodiments. It is to be understood that these reference numerals are limitedly applied only to the drawing(s) and element(s) related with the intended exemplary embodiment, and not to be extended to the other exemplary embodiments. For example, FIGS. 1 to 3 are drawings related with the first exemplary embodiments, FIGS. 4 to 8 are related with the second exemplary embodiment, and FIGS. 9 to 11 are related with the third exemplary embodiments, and the same reference numerals used in these exemplary embodiments do not necessarily mean that the elements referred by these same reference numerals are the same. Accordingly, the reference numerals designated to the elements illustrated in FIGS. 1 to 3 are applied only to the elements of the first exemplary embodiment, and not to be extended to the second or the third exemplary embodiment which will be described thereafter. This applies also to the second and the third exemplary embodiments.

First, the axial-flow compressor will be briefly described with reference to FIG. 1. The axial-flow compressor mainly includes a rotating portion 400 and an outer casing 300. The rotating portion 400 includes a rotational shaft 401, and a plurality of rotors (i.e., blades) 402 disposed along a circumferential direction of the rotational shaft 401. A plurality of stators 302 is provided on the outer casing 300 corresponding to the rotor blades 402. The fluid entering the compressor is compressed while it passes through the rotating rotor blades 402 and stationary stators 302, and then discharged.

Meanwhile, the axial-flow compressor may suffer stall due to unexpected situation at a high efficiency region, i.e., at the region with a low flow rate and high pressure. The casing treatment 301 may be provided on the outer casing 300 to prevent this, but it disadvantageously gives negative influence on the compressor performance by deteriorating compressor efficiency, for example.

The present disclosure is characterized that the casing treatment formed on the outer casing is allowed to be opened and closed easily, to thus maintain stall under control and also to maintain compressor efficiency, and at the same time, to be adaptable for a casing with variously shaped slot.

As illustrated in FIGS. 2 and 3, the stall preventing apparatus of axial-flow compressor according to the present disclosure prevents stall of the axial-flow compressor which has the outer casing 3 having a slot (casing treatment) 31 formed in an inner wall facing the rotor blade 402, and includes, as main components, an inner casing 1 and a drive means 2 for driving the inner casing 1.

First, the inner casing 1, positioned inside the outer casing 3, is moveable in an axial direction of the outer casing 3 to open the slot 31 of the outer casing 3 in a unstable operating region, to close the slot 31 of the outer casing 3 in a stable operating region.

Meanwhile, the outer casing 3 includes a cavity 32 fluidly communicated with the slot 31 in an axial direction of the outer casing and positioned inside the outer casing 3. When the cavity 32 is "positioned inside the outer casing 3", this means that the cavity 32 is positioned between the inner wall and outer wall of the outer casing 3, so that the cavity 32 is not exposed to the operating fluid passing the compressor, nor to outside except for the slot 33 described below.

Further, the outer casing 3 includes the slot 33 in fluid communication with the cavity 32 in a direction of wall thickness of the outer casing.

The drive means 2 operates to move the inner casing 1 in the axial direction of the outer casing 3, and includes a connecting member 21 extended to the outside through the slot 33, and a moving means 22 for moving the connecting member 21 in the axial direction of the outer casing 3.

Specifically, the moving means 22 is connected with the connecting member 21, and includes a cylinder 221 whose interior is divided by a partition into a left side and a right side, a first valve 222 and a second valve 223 which can regulate the inflow of high pressure air from the downstream of the axial-flow compressor into the cylinder 221, and a third valve 224 and a fourth valve 225 which can regulate an outflow of the higher pressure air introduced into the cylinder 221. Of course, the moving means 22 may employ additional known equipment such as hydraulic system. For example, fluid pressure from the hydraulic system mounted to the aircraft engine may be employed.

Meanwhile, the connecting member 21 may include a first connecting member 211 connected with the inner casing 1, and a second connecting member 212 connected, with both ends, with the first connecting member 211 and the partition of the cylinder 221. For reference, as illustrated in FIG. 2, the second connecting member 212 may be disposed in parallel with the axial direction of the compressor and the first connecting member 211 may be disposed in perpendicular relation with the axial direction of the compressor.

Hereinbelow, the operation of the stall preventing apparatus of axial-flow compressor configured as described above, will be described.

First, in the operating region where instability occurs, i.e., where the operating line of the compressor approaches near to the stall, it is necessary to move the slot 31 of the outer casing 3 to downstream direction (i.e., right direction in FIG. 2) of the operating fluid to expose the slot 31 to the operating fluid. To this end, the drive means 2 opens the first valve 222 and the fourth valve 225, and closes the second valve 223 and the third valve 224, to thus allow the high pressure air to be introduced to the left side of the cylinder 221.

Thus, the connecting member 21 is moved to the downstream direction of the operating fluid, with the inner casing 1 connected with the connecting member 21 also moving to the downstream direction of the operating fluid, toward the cavity 32 of the outer casing 3. At this time, the casing slot 31 is exposed to the operating fluid, and as the high pressure air at the downstream within the casing slot 31 is recirculated to upstream, stall is prevented. As a result, the operating region is increased.

Meanwhile, an interval g (in wall thickness direction of the outer casing) in fluid communication between the slot 31 and the cavity 32 of the outer casing 3 preferably corresponds to the wall thickness of the inner casing 1 so that the operating fluid introduced into the casing slot 31 is prevented from being introduced into the cavity 32 through a gap formed between the inner casing 1 and the outer casing 3. When "the interval g in fluid corresponds to the wall thickness of the inner casing 1", it means that the gap between the inner casing 1 and the outer casing 3 is tightly closed so that there is substantially no difference between the interval g in fluid communication and the wall thickness of the inner casing 1. Meanwhile, at a portion in fluid communication between the slot 31 and the cavity 32 of the outer casing 3, a known airtightness maintaining member such as a seal may be additionally applied between the inner casing 1 and the outer casing.

Next, during driving at a stable region where the operating line of the compressor is at a significant distance away from the stall, it is necessary that the slot 31 of the outer casing 3 is not exposed to the operating fluid.

To this end, the inner casing 1 has to be moved to the upstream direction of the operating fluid (i.e., left direction in FIG. 2), and to do so, high pressure air is introduced into the right side of the cylinder 221 by opening the second valve 223 and the third valve 224, and closing the first valve 222 and the fourth valve 225. As a result, the connecting member 21 is moved to the upstream direction of the operating fluid and the inner casing 1, which is connected with the connecting member 21, is also moved to the upstream direction of the operating fluid, according to which the inner casing 1 is moved to a direction of being separated from the cavity 32 of the outer casing 3. At this time, as the casing slot 31 is closed from exposure to the operating fluid, the problem of deteriorated performance such as deteriorating compressor efficiency can be prevented.

Meanwhile, the operating region having the instability of the operating line of the compressor approaching near to the stall, and the stable operating region where the operating line of the compressor is at a significant distance away from the stall, may be previously set based on experimental data, etc.

Accordingly, while the related technology employs a structure which is applicable only when the moving direction of the drive portion 22, direction of slope of the adjustment hole 31, and the direction of the adjustment rib 35 are in agreement with each other, and thus is applicable only to the casing 10 in which the slope l of the adjustment hole 31 varies along a circumferential direction, the stall preventing apparatus of axial-flow compressor impeller according to the exemplary embodiment of the present disclosure is applicable even to a casing 6 in which the slope l of the slot 101 does not vary, but remains constant in the circumferential direction. Accordingly, the stall preventing apparatus of axial-flow compressor impeller of the present disclosure improves the drawback of the related technology, i.e., improves deteriorated stall preventing or delaying effect due to direction of slope of the slot which is formed opposite to the rotational direction of the blade, according to which flow is not allowed to move into the slot, thus failing to guide the air in the downstream toward upstream. Further, the stall preventing apparatus of axial-flow compressor impeller according to the present disclosure is applicable to a casing in which the slot has a constant slope according to the rotational position of the rotor, and thus can contribute to improvement of overall stability of the axial-flow impeller.

Figure 4:
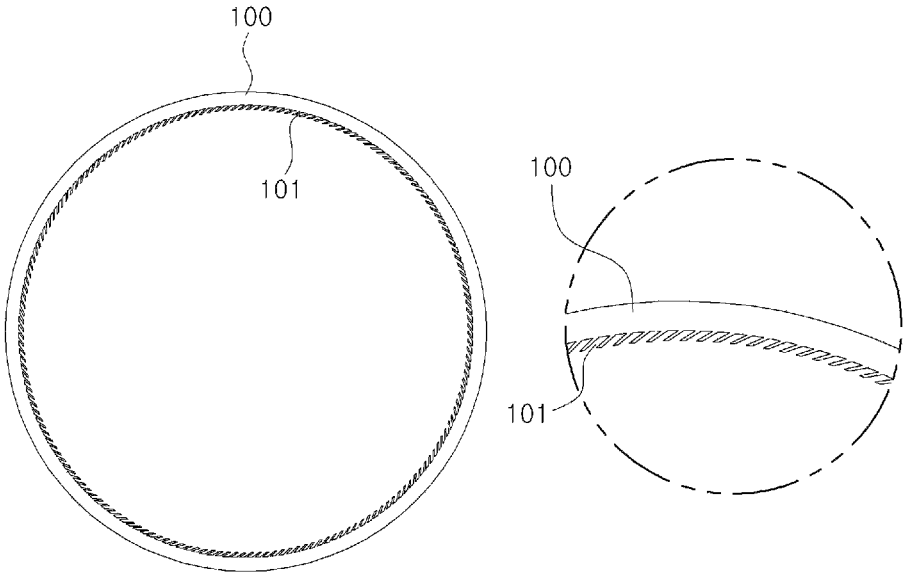
FIG. 4 illustrates a casing with an axial skewed slot formed in an axial direction.

Hereinbelow, an apparatus for preventing an axial-flow compressor from stalling by employing a casing treatment according to another exemplary embodiment (i.e., second exemplary embodiment) of the present disclosure will be described in detail with reference to FIGS. 4 to 8. For convenience of explanation, it is exemplified herein that the stall preventing apparatus of axial-flow compressor is applied to a casing 100 having an axial skewed slot 101 formed as illustrated in FIG. 4. However, exemplary embodiments are not limited to the specific example provided herein. Accordingly, the stall preventing apparatus may be modified and applied to, for example, a casing with various slot shape such as a radial slot having a slope in a radial direction.

Further, the casing may be divided into several regions and of the stall preventing apparatus of axial-flow compressor may be disposed for each one of the regions. Depending on needs, the number of stall preventing apparatuses of axial-flow compressor may be appropriately adjusted.

Figure 5:
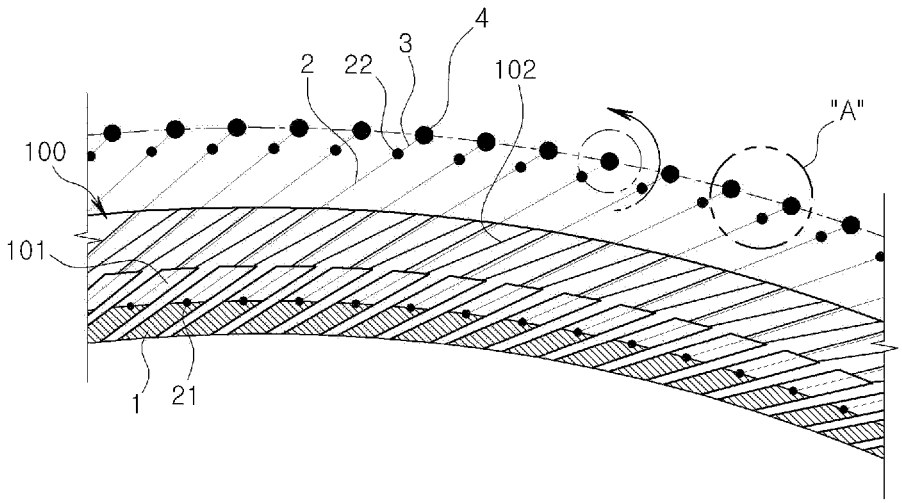
FIG. 5 illustrates the slot of the casing closed by using a stall preventing apparatus of axial-flow compressor according to another exemplary embodiment of the present disclosure.
Figure 6:
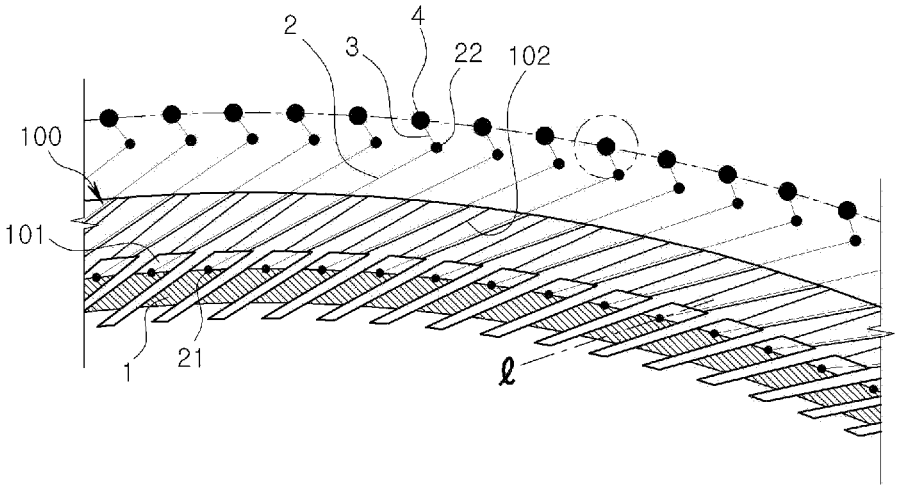
FIG. 6 illustrates a rotational shaft rotated counterclockwise by 90 degrees compared to the state illustrated in FIG. 5, in order to open the slot of the casing by using the stall preventing apparatus of axial-flow compressor of FIG. 5.

For reference, FIG. 5 illustrates the slot of the casing closed by using a stall preventing apparatus of axial-flow compressor according to an exemplary embodiment of the present disclosure, FIG. 6 illustrates a rotational shaft rotated counterclockwise by 90 degrees compared to the state illustrated in FIG. 5, in order to open the slot of the casing by using the stall preventing apparatus of axial-flow compressor of FIG. 5. FIG. 7 illustrates a rotational shaft rotated counterclockwise by 180 degrees compared to the state illustrated in FIG. 5, in order to open the slot of the casing by using the stall preventing apparatus of axial-flow compressor of FIG. 5. FIG. 8 is a partially enlarged view of encircled area "A" of FIG. 5, illustrating an example of arrangement of a rotational shaft and a driving force transmitting member. Meanwhile, it is exemplified herein that the rotational shaft is in the counterclockwise direction, but one will obviously understand that the rotation may be clockwise.

As illustrated in FIGS. 5 to 7, the stall preventing apparatus of axial-flow compressor according to the present disclosure having a casing 100 with a plurality of slots 101 formed therein, operates to prevent the axial-flow compressor from stalling, and includes a slider 1, a first link 2, a second link 3 and a rotational shaft 4.

The slider 1 is positioned at the slots 101 of the casing 100, and is preferably disposed in close contact with a sidewall of the slots 101 to prevent ingress of the operating fluid within the casing 100 through a gap between the slider 1 and the casing slots 101. Of course, depending on need, anti-wear coating or airtightness maintaining member such as seal may be additionally provided at a contact between the slider 1 and the slots 101. Further, the slider 1 is slidable within the casing slots 101.

The first link 2 is a bar type member having rigidity, which is connected with the slider 1 with one end, and is rotatable with relative to the slider 1. The first link 2 and the slider 1 are so connected to have a degree of freedom with each other, and to this end, a first ring member 21 in a ring shape may be used.

Meanwhile, a passing hole 102 may be formed in the casing 100 for the first link 2 to pass therethrough. The passing hole 102 is preferably formed in a size and a shape that will not allow interference between the two when the first link 2 is moved.

The second link 3 is a bar-type member having rigidity, of which one end is connected with the other end of the first link 2 and is rotatably relative to the other end of the first link 2. Likewise, the second link 3 and the first link 2 are connected with each other with a degree of freedom therebetween, and to this purpose, a second ring member 22 in a ring shape may be used.

The rotational shaft 4 is fixedly coupled with the other end of the second link 3. That is, unlike the manner that the slider 1 and the first link 2 are connected, or the manner that the first link 2 and the second link 3 are connected, the second link 3 is fixedly connected with the rotational shaft 4. Accordingly, the second link 3 is rotated about a center of the rotational shaft 4 at same angle, when the rotational shaft 4 is rotated. For example, when the rotational shaft 4 is rotated counterclockwise by 90 degrees, the second link 3 is also rotated about the rotational shaft 4 counterclockwise by 90 degrees. The rotational shaft 4 may be integrally formed with the second link 3, or separately formed and then fixedly coupled afterward.

Further, as illustrated in FIG. 8, the stall preventing apparatus of axial-flow compressor may additionally include a drive portion 6 to rotate any one of a plurality of rotational shafts 4.

The drive portion 6 includes a fixing member 61 fixed with one end thereof to any one of a plurality of rotational shafts 4, and an actuator 62 connected with one end thereof to the other end of the fixing member 61 with a degree of freedom to rotate the fixing member 61. Herein, the other end of the actuator 62 may be connected to the casing 100 for example, while having a degree of freedom through the third ring member 63 in a ring shape.

Meanwhile, the components connected with each other using the ring members as described above may employ other connecting manner such as hinge coupling, for example, as far as the components can achieve the same effect of operation.

Further, a drive force transmitting member 5, such as a gear, may be disposed between a plurality of rotational shafts 4 so that the rotational shafts 4 rotate in the same direction. The drive portion 6 may directly rotate one of the plurality of rotational shafts 4 as a driving shaft, in which case the rest of the rotational shafts 4 are driven as driven shafts. Accordingly, the drive force transmitting member 5 may be disposed between the driving shaft and the driven shafts as an intermediate shaft, so that the driving and driven shafts are rotated in the same direction. A known drive force transmitting member 5 such as an idle gear may be used.

Meanwhile, a circle formed by the plurality of rotational shafts is arranged with the same center of curvature as that of the casing 100.

Hereinbelow, an action (i.e., operation) of the stall preventing apparatus of axial-flow compressor with configuration described above will be explained.

First, as illustrated in FIG. 5, during an operation with the operating line of the compressor maintained at a significant distance away from the stall, it is necessary that the slot 101 of the casing 101 is not exposed to the operating fluid.

To this purpose, the first link 2 and the second link 3 are aligned in a line with an intervention of the second ring member 22 therebetween. In this state, the slider 1 is also at a downwardly-moved state within the casing slot 101, where the slot 101 is not exposed to the operating fluid, but closed. Accordingly, the problem of reduced performance, such as deteriorated compressor efficiency can be solved.

Next, in an operating region where instability occurs, i.e., when the operating line of the compressor approaches closer to the stall, it is necessary to expose the slot 101 of the casing 100 to the operating fluid.

To this purpose, as illustrated in FIGS. 6 to 8, the drive portion 6 is operated to rotate the rotational shaft 4 which is the driving shaft among the plurality of rotational shafts 4. As a result, the rest of the rotational shafts 4 are rotated in the same rotational direction as the driving shaft through the drive force transmitting member 5. By finally rotating the rotational shaft 4 counterclockwise by 180 degrees, the slider 1 is moved within the casing slot 101 to upper direction, according to which the slot 101 is opened to the maximum degree to the exposure to the operating fluid. In this situation, the high pressure air at the downstream of the compressor is introduced into the slot 101 and re-circulated to the upstream, thus controlling the stall and extending the operating region. Of course, to ensure that no interference occurs due to contact between the first link 2 and the rotational shaft 4 during the process the rotational shaft 4 is rotated from the state of FIG. 6 to the state of FIG. 7, the first link 2 may be preferably protruded slightly forward, farther than the rotational shaft 4 (see FIG. 8).

As described above, unlike the related technology in which the structure is limitedly applied to the casing 10 in which the slope l of the adjustment slot 31 is varied in a circumferential direction, due to the structure thereof which is applicable only when the moving direction of the drive portion 33, direction of slope of the adjustment slot 31, and direction of the adjustment rib 32 are in agreement with each other, the stall preventing apparatus of axial-flow compressor impeller according to the exemplary embodiment is applicable also to a casing 100 in which the slope l of the slot 101 is not varied along a circumferential direction, but remains constant. Accordingly, the stall preventing apparatus of axial-flow compressor impeller according to the exemplary embodiment can improve the problem of the related technology, which is, the deteriorated stall controlling or delaying effect experienced when the direction of slope of the slot is opposite to the rotational direction of the blade so that the flow does not enter into the slot and the downstream air is not guided to the upstream. Further, the stall preventing apparatus of axial-flow compressor impeller according to the exemplary embodiment can contribute to improvement of overall stability of the axial-flow impeller, as it is applicable also to a casing where the slope of the slot is constant, according to a rotational position of the rotor.

Hereinbelow, an apparatus for preventing an axial-flow compressor from stalling by employing a casing treatment (hereinbelow, 'the stall preventing apparatus of axial-flow compressor') according to yet another exemplary embodiment (i.e., third exemplary embodiment) will be described with reference to FIGS. 9 to 11. Meanwhile, for convenience of explanation, a radial slot type casing, in which the slope of the slot is extended in a radial direction, is exemplified herein, but exemplary embodiments are not limited to this example only. Accordingly, the stall controlling apparatus of axial-flow compressor may also be applied to an axial skewed slot which is slanted with relation to a direction of radius. That is, the stall preventing apparatus of axial-flow compressor according to an exemplary embodiment is applicable to various shapes of slots.

For reference, FIG. 9 illustrates a main configuration of a stall preventing apparatus of axial-flow compressor according to yet another exemplary embodiment of the present disclosure, FIG. 10 illustrates the state in which the slot of the casing is closed by using the stall preventing apparatus of axial-flow compressor of FIG. 9, and FIG. 11 illustrates the state in which the slot of the casing is opened by using the stall preventing apparatus of axial-flow compressor of FIG. 9.

As illustrated in FIG. 9, the stall preventing apparatus of axial-flow compressor according to an exemplary embodiment is configured to control the stalling of the axial-flow compressor which has a slot (i.e., casing treatment) formed on an inner wall of the casing, facing the rotor, and includes a slider 1, a rod 2, a roller 3, and an arm 4.

The slider 1 is positioned in the slot 61 of the casing 6, and preferably in a close contact with the sidewall of the slot 61 so as not to allow the operating fluid within the casing 6 to escape through the casing slot 61. Of course, depending on needs, an airtightness maintaining member such as a seal may be additionally employed at a contact between the slider 1 and the slot 61. Further, the slider 1 is slidable within the casing slot 61 by the operation of the drive portion 5 which will be described below.

The rod 2 is connected with the slider 1. The rod 2 may be integrally formed with the slider 1, or alternatively, formed separately and fixedly coupled with the slier 1 afterward.

The roller 3 is provided in a circular form to enable rolling motion, and has a concave portion 35 on an outer circumference in a circumferential direction. Further, the roller 3 is connected with a center thereof to one end of the rod 2, for relative rotation about the one end of the rod 2. For the connection between the roller 3 and one end of the rod 2, a known fastener may be employed.

The arm 4 is so formed that it allows the roller 3 to move in a rolling motion. Specifically, the arm 4 includes an upper rail 41 and a lower rail 42 connected with each other to form a closed curve. The rails 41, 42 are connected with each other with both ends thereof. Further, the upper rail 41 and the lower rail 42 each include protrusions 411, 421 facing each other, to correspond to the concave portion 35 of the roller 3, so that the roller 3 is stably moved in rolling motion between the upper rail 41 and the lower rail 42 without separating from the arm 4.

Herein, the arm 4 is arranged with the same center of curvature as that of the casing 6. That is, the distance between the lower rail 42 of the arm 4 and the casing 6 is constant at any point in the circumferential direction.

Meanwhile, the stall preventing apparatus of axial-flow compressor according to an exemplary embodiment additionally includes a drive portion 5 to move the arm 4 in a radial direction of the casing 6. The drive portion 5 may be connected with the arm 4 and move the arm 4 toward or away from the casing 6 in the radial direction of the casing 6, using a known device such as a hydraulic system including an actuator.

Hereinbelow, an action (i.e., operation) of the stall preventing apparatus of axial-flow compressor configured as described above will be explained. FIGS. 10 and 11 illustrate an example in which the casing 6 is divided into four regions and the stall preventing apparatus of axial-flow compressor is arranged in one of the divided regions. Of course, the number of the stall preventing apparatuses of axial-flow compressor may be appropriately adjusted to suit needs. Hereinbelow, the operation of the stall preventing apparatus of axial-flow compressor will be described with reference to FIGS. 10 and 11 for convenience of explanation.

First, as illustrated in FIG. 11, in the operating region where instability occurs, i.e., where the operating line of the compressor approaches near to the stall, it is necessary to expose the slot 61 of the casing 6 to the operating fluid.

To this purpose, the drive portion 5 is operated to move the arm 4 in a direction away from the casing 6 (upward direction in FIG. 11). Accordingly, the slider 1 is also moved within the casing slot 61 to an upward direction, according to which the slot 61 is exposed to exposure to the operating fluid. At this time, the high pressure air at the downstream of the compressor is re-circulated to the upstream through the slot 61, thus controlling the stall and extending the operating region. Herein, a plurality of rollers 3 positioned on the arm 4 are moved so that intervals therebetween increase, compared to when the operation is performed with the operating line of the compressor maintained at a significant distance away from the stall, which will be described below.

The rod 2 is aligned in a radial direction to constantly face the center of curvature of the casing 6. Of course, in the example of the axial skewed slot which is slanted with relation to the radial direction, the rod is also aligned at a slope with respect to the radial direction.

Next, as illustrated in FIG. 10, during operation in which the operating line of the compressor is at a significant distance from the stall, it is necessary that the slot 61 of the casing 6 is not exposed to the operating fluid.

To this purpose, the drive portion 5 is operated to move the arm 4 to a direction of moving closer to the casing 6 (i.e., downward direction in FIG. 10). As a result, the slider 1 is also moved downward within the casing slot 61, according to which the slot 61 is not exposed to the operating fluid, but closed. Accordingly, since the casing slot 61 is not exposed to the operating fluid, but closed, the problem of deteriorated performance such as deteriorated compressor efficiency can be solved.

In this situation, compared to the operating region described above where instability occurs in which the operating line of the compressor approaches closer to the stall, the plurality of rollers 3 positioned on the arm 4 are moved so that intervals therebetween decrease. In this case too, the rod 2 is aligned in the radial direction to constantly face the center of curvature of the casing 6.

Meanwhile, the operating region having the instability of the operating line of the compressor approaching near to the stall, and the stable operating region where the operating line of the compressor is at a significant distance away from the stall, may be previously set based on experimental data, etc.

Figure 12:
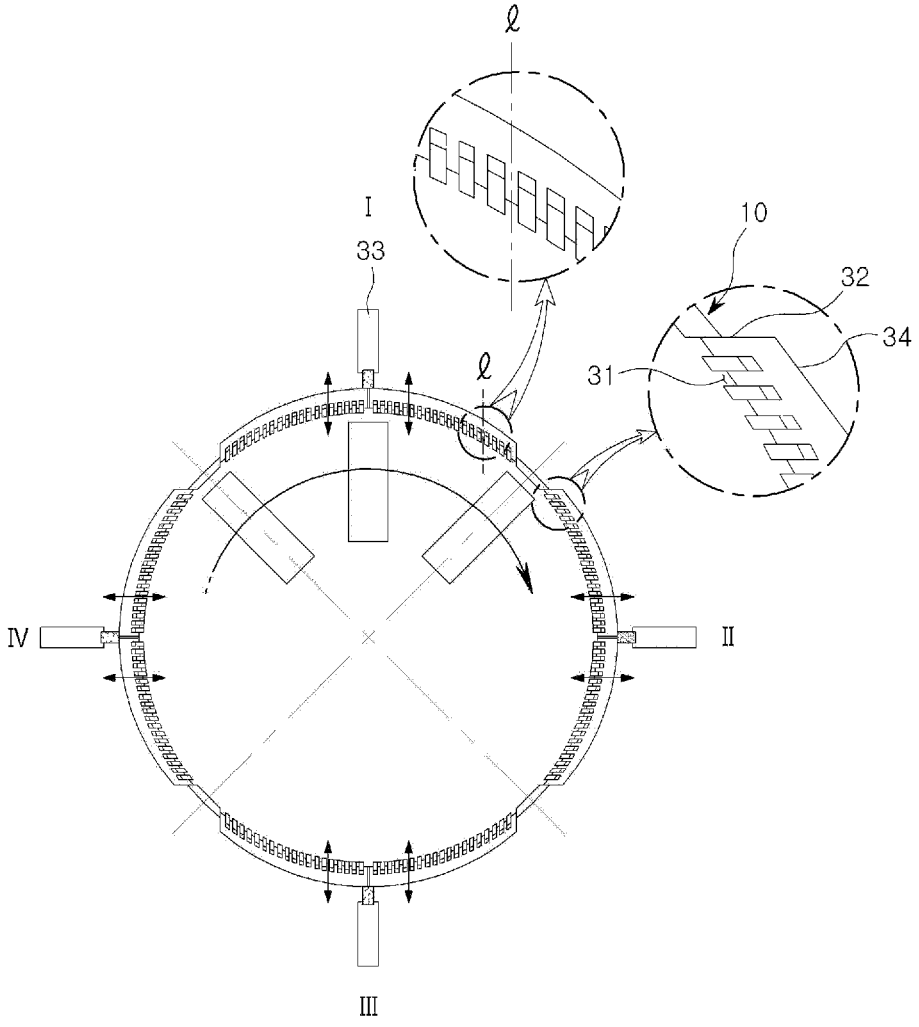
FIG. 12 illustrates a conventional fluid stabilizer of an axial-flow compressor.

As described above, unlike the related technology (see FIG. 12) in which the structure is limitedly applied to the casing 500 in which the slope l of the adjustment slot 610 is varied in a circumferential direction, due to the structure thereof which is applicable only when the moving direction of the drive portion 700, direction of slope of the adjustment slot 610, and direction of the adjustment rib 620 are in agreement with each other, the stall preventing apparatus of axial-flow compressor according to the exemplary embodiment is applicable also to a casing 6 in which the slope l of the slot 61 is not varied along a circumferential direction, but remains constant, because it is possible to increase or decrease the distance between the rollers 3 connected with the plurality of rods 2 on the arm 4 in accordance with opening (FIG. 11) or closing (FIG. 10) of the slot 61. Accordingly, the stall preventing apparatus of axial-flow compressor according to the exemplary embodiment can improve the problem of the related technology, which is, the deteriorated stall controlling or delaying effect experienced when the direction of slope of the slot is opposite to the rotational direction of the blade so that the flow does not enter into the slot and the downstream air is not guided to the upstream. Further, the stall preventing apparatus of axial-flow compressor according to the exemplary embodiment can contribute to improvement of overall stability of the axial-flow compressor, as it is applicable also to a casing where the slope of the slot 61 is constant, according to a rotational position of the rotor.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

INDUSTRIAL APPLICABILITY

The exemplary embodiments are applicable to aircraft engine or industrial gas turbine.

The invention claimed is:

1. An apparatus for preventing an axial-flow compressor from stalling by employing a casing treatment, in which the axial-flow compressor comprises a casing having a plurality of slots formed in an inner wall faced with a rotor, the apparatus comprising:

a plurality of sliders to be slidably inserted into the plurality of slots, respectively;

a plurality of first links, each of the plurality of first links having one end connected with one of the plurality of sliders, respectively, and the plurality of first links being rotatable relative to the plurality of sliders;

a plurality of second links, each having one end connected with an other end of the plurality of first links, respectively, and being rotatable relative to the other ends of the plurality of first links; and a plurality of rotational shafts fixedly coupled with other ends of the plurality of second links, respectively, wherein a drive force transmitting member is disposed between the plurality of rotational shafts so that the plurality of rotational shafts are rotated in a same direction.

2. The apparatus of claim 1, wherein each of the plurality of sliders and each of the plurality of first links coupled with each other are connected to be rotated relative to each other through a first ring member.

3. The apparatus of claim 1, wherein each of the plurality of the first links and each of the plurality of second links coupled with each other are connected to be rotated relative to each other through a second ring member.

4. The apparatus of claim 1, wherein the drive force transmitting member is a gear.

5. The apparatus of claim 1, further comprising a drive portion to rotate one of the plurality of rotational shafts as a driving shaft.

6. The apparatus of claim 5, wherein the drive portion comprises a fixing member and an actuator, wherein one end of the fixing member is fixed to one of the plurality of rotational shafts and one end of the actuator is connected with the other end of the fixing member with a degree of freedom to rotate the fixing member.

7. The apparatus of claim 6, wherein the other end of the actuator is connected with the casing through a third ring member having a ring shape, while having a degree of freedom.

8. The apparatus of claim 1, wherein, in an unstable operating region, the plurality of sliders are ascended within the plurality of slots to open the plurality of slots, while in a stable operating region, the sliders are descended within the plurality of slots to close the plurality of slots.

9. The apparatus of claim 1, wherein a circle formed by the plurality of rotational shafts has a same center of curvature as that of the casing.

10. The apparatus of claim 1, wherein the casing has a plurality of passing holes through which the plurality of first links are passed.

11. The apparatus of claim 4, further comprising a drive portion to rotate one of the plurality of rotational shafts as a driving shaft.

* * * * *